US008683626B1

(12) United States Patent
Kaczmarek

(10) Patent No.: US 8,683,626 B1
(45) Date of Patent: Apr. 1, 2014

(54) HOSPITAL BED WITH CONVEYOR MATTRESS

(71) Applicant: Karen S. Kaczmarek, Hollidaysburg, PA (US)

(72) Inventor: Karen S. Kaczmarek, Hollidaysburg, PA (US)

( * ) Notice: Subject to any disclaimer, the term of this patent is extended or adjusted under 35 U.S.C. 154(b) by 0 days.

(21) Appl. No.: 13/744,189

(22) Filed: Jan. 17, 2013

(51) Int. Cl.
*A61G 7/008* (2006.01)
*A61G 7/14* (2006.01)

(52) U.S. Cl.
USPC ..... 5/81.1 C; 5/610; 5/611; 5/612; 5/614; 5/943; 5/503.1

(58) Field of Classification Search
USPC ..... 5/81.1 C, 487, 607, 610, 612, 614, 616, 5/943, 503.1
See application file for complete search history.

(56) References Cited

U.S. PATENT DOCUMENTS 1,318,271 A * 10/1919 Ford ..... 5/600
1,793,006 A * 2/1931 O'Neill ..... 5/600
1,877,610 A * 9/1932 Steiner ..... 108/90
3,388,406 A * 6/1968 Scrivener ..... 5/488
3,641,600 A * 2/1972 Oats ..... 5/488
3,810,263 A * 5/1974 Taylor et al. ..... 5/81.1 C
3,835,486 A 9/1974 Benoit et al.
4,183,015 A 1/1980 Drew et al.
4,369,533 A * 1/1983 Gisiger ..... 5/607
4,459,712 A * 7/1984 Pathan ..... 5/81.1 C
5,718,009 A * 2/1998 Lin ..... 5/487
5,966,760 A * 10/1999 Gallant et al. ..... 5/658
6,499,156 B1 * 12/2002 Dirst ..... 5/81.1 C
6,594,837 B2 * 7/2003 Khait ..... 5/600
6,611,974 B2 * 9/2003 Roit et al. ..... 5/81.1 C
7,337,478 B1 * 3/2008 Lake ..... 5/81.1 C
2002/0023297 A1 * 2/2002 Khait ..... 5/600

* cited by examiner

*Primary Examiner* — William Kelleher
*Assistant Examiner* — David R Hare

(57) ABSTRACT

A hospital bed with conveyor mattress that includes a loop mattress disposed overlying and attached to a conveyor belt disposed in operational communication with a plurality of transverse rollers horizontally disposed within a mattress frame, wherein the loop mattress is moveable in each of a first direction and a second direction and a plurality of hydraulic jacks enable inclinations of specific sections of the mattress relative each other to comfortably position a patient disposed upon the bed, as desired, and extant electronics and medical accoutrements are supportable, powerable, and securable proximal a patient disposed in the bed, whereby a patient is moveable upon the mattress at the press of a button and able to control peripheral electronics while in bed.

3 Claims, 5 Drawing Sheets

HOSPITAL BED WITH CONVEYOR MATTRESS

BACKGROUND OF THE INVENTION

Various types of hospital beds with conveyor mattresses are known in the prior art. However, what is needed is a hospital bed with conveyor mattress that includes a loop mattress disposed overlying and attached to a conveyor belt disposed in operational communication with a plurality of transverse rollers horizontally disposed within a mattress frame, wherein the loop mattress is moveable in each of a first direction and a second direction and a plurality of hydraulic jacks enable inclinations of specific sections of the mattress relative each other to comfortably position a patient disposed upon the bed, as desired, and extant electronics and medical accoutrements are supportable, powerable, and securable proximal a patient disposed in the bed, whereby a patient is moveable upon the mattress at the press of a button and able to control peripheral electronics while in bed.

FIELD OF THE INVENTION

The present invention relates to a hospital bed with conveyor mattress, and more particularly, to a hospital bed with conveyor mattress that includes a loop mattress disposed overlying and attached to a conveyor belt disposed in operational communication with a plurality of transverse rollers horizontally disposed within a mattress frame, wherein the loop mattress is moveable in each of a first direction and a second direction and a plurality of hydraulic jacks enable inclinations of specific sections of the mattress relative each other to comfortably position a patient disposed upon the bed, as desired, and extant electronics and medical accoutrements are supportable, powerable, and securable proximal a patient disposed in the bed, whereby a patient is moveable upon the mattress at the press of a button and able to control peripheral electronics while in bed.

SUMMARY OF THE INVENTION

The general purpose of the hospital bed with conveyor mattress, described subsequently in greater detail, is to provide a hospital bed with conveyor mattress which has many novel features that result in a hospital bed with conveyor mattress which is not anticipated, rendered obvious, suggested, or even implied by prior art, either alone or in combination thereof.

The present hospital bed with conveyor mattress has been devised to enable positioning of a patient among various inclinations relative the horizontal and reposition said patient longitudinally upon the bed by means of a loop mattress disposed overlying a conveyor belt operationally engaged by a plurality of transverse rollers disposed within a mattress frame. The instant hospital bed with conveyor mattress also includes state of the art electronic interfacing to enable control of peripheral electronic devices proximal the bed from within the bed, as well as support and maintain in relevant position a number of extant peripheral medical devices common in treatment of patients in hospital.

The present hospital bed with conveyor mattress, therefore, includes a loop mattress disposed within a mattress frame. The loop mattress is a padded member looped around and attached to a conveyor belt rotationally disposed upon a plurality of transverse rollers horizontally disposed transversely within the mattress frame. When each of the plurality of transverse rollers is caused to rotate, the conveyor belt causes the loop mattress to rotate along a longitudinal axis relative the mattress frame. Thus the loop mattress is moveable in each of a first direction and a second direction.

At least one roller motor is disposed in operational communication with at least one of the plurality of transverse rollers. When said roller motor is activated, the loop mattress is thus caused to move in a first direction and alternately a second direction, as desired for positioning a patient upon the mattress towards and alternately away from a headboard, as desired.

A plurality of hydraulic jacks is disposed on either side of the mattress frame, each of said plurality of hydraulic jacks extensible to position sections of the mattress at various inclines relative the horizontal, whereby a patient is positional at various inclines and situations, for example in the Trendelenburg position, with feet raised above the head, or in a seated reclined position with the head and torso raised and the feet raised to a lesser degree than the torso, for example. Each of the hydraulic jacks is pivotally attached to the mattress frame to enable tilting off the vertical relative the extension of another of the plurality of hydraulic jacks.

A headboard is disposed perpendicularly at the anterior end of the bed. The headboard includes structure to position and secure extant peripheral medical paraphernalia and accoutrements, as desired. A telescopic IV support pole is attached to the headboard, and vertically extensible therefrom, enabling support of equipment required to administer intravenous treatment to a particular patient in the bed.

An oxygen tank holder is also disposed upon the headboard, configured to releasably secure an oxygen tank (or other compressed gas tank) to the headboard proximal a patient requiring use of such apparatus. The oxygen tank holder is contemplated to pop-out of the headboard, or otherwise fold away into the headboard when not in use, to maintain a flush surface of the headboard to save space, as desired.

A drop-down foldable shelf is also included in the headboard, configured to fold down out of the headboard to support portable electronic equipment, as desired, for monitoring particular conditions of the patient, for example, or other accoutrements as convenient for treating a particular patient in the bed.

A conveyor button is disposed upon the side of the headboard whereby the at least one roller motor is activatable to move the loop mattress (and any patient disposed thereupon) in each of the first direction and the second direction. The conveyor button may be encased (as illustrated herein) in a closable safety box to prevent accidental depression whereby undesired movement of a patient is preempted.

Thus, for example, a medical professional is able to raise a patient into a seated position by raising the section of mattress underlying the patient's torso by use of the plurality of hydraulic jacks, and subsequently activating the conveyor belt to position the patient in an upright and seated position, without having to physically lift the patient into the desired position. Since many procedures are better administered with the patient in an upright position, this feature of the instant hospital bed with conveyor mattress will save medical professionals much physical exertion and patient discomfort.

A footboard is perpendicularly disposed at the posterior end of the bed. The footboard includes a first surface having a plurality of holes disposed thereupon. Each of the plurality of holes is configured to releasably receive and selectively secure each of a plurality of hooks therein. Each of the plurality of hooks is thus securable within any one of the plurality of holes, and an arrangement of hooks is engendered whereby a specific support structure for desired accoutrements is enabled when treating a patient within the present hospital bed with conveyor mattress. When not in use, each of the plurality of hooks is storable within a hook drawer disposed in the footboard and accessible from the first surface.

To enable powering of extant electronics desirably positioned proximal the hospital bed, at least one outlet is disposed upon the footboard. The at least one outlet enables interconnection of electronic devices with an extant power source externally connected to the bed and preempts the need of using a wall outlet which may require longer chords for use by a patient within the bed. Thus a patient is enabled to use a laptop computer, for example, or recharge a cell phone, for example, as well as medical professionals power additional medical paraphernalia which may be used when treating a particular patient.

An electronics panel is disposed in the footboard with a variety of indicators disposed thereupon. The electronics panel is contemplated to include a Trendelenburg position indicator, a reverse Trendelenburg position indicator, an alarm signal, a scale readout, and a bed elevation indicator. Thus a medical professional is alerted as to what position or situation the bed is in, whether or not an alarm signal has been activated, and may read the weight of a patient lying in the bed, said weight readable from the footboard without the patient having to be weighed external to the bed. A number of preset buttons may also be included enabling one-touch activation of preset conditions and situations of the bed; for example, the Trendelenburg position may be activated by pressing a single button whereby the feet of a patient lying in the bed are raised a certain height above said patient's head.

In order to read a patient's weight, sensors may be disposed in the mattress frame, in the hydraulic jacks, or where the plurality of rollers connect to the mattress frame, for example. Thus, the weight of a patient lying in the bed is communicated through the mattress frame and displayed in real time upon the footboard.

To protect the electronics panel when not in use, or to cover the panel to lessen light within the particular room with which the bed is in use, a hinged lid is disposed in the footboard to cover the electronics panel, as desired.

Enclosing the hospital bed with conveyor mattress on both sides is a plurality of side rail members. Each of the plurality of side rail members is moveable from an upright position enclosing the bed along each side and a lowered position whereby access to the bed is enabled. The plurality of side rail members includes a first pair of side rail members disposed more proximal to the headboard, and a second pair of side rail members disposed more proximal the footboard.

A plurality of controls is disposed on at least one of the first pair of side rail members whereby a patient is enabled to control the hospital bed with conveyor mattress. The patient is thus enabled to activate the rollers, raise or lower desired sections of the bed to engender a desired position (such as recline, horizontal, Trendelenburg position, etc.) as well as interface with peripheral electronics proximal the bed, for example, said peripheral electronics including an intercom, a telephone, a television, or other electronic apparatus desirably accessible and controllable from the hospital bed with conveyor mattress. In the preferred embodiment herein disclosed, a plurality of controls is likewise disposed on the outside of one of the pair of first side rail members for use by a person at the bedside—including, for example, a medical professional or a visitor, family member, or friend.

Thus has been broadly outlined the more important features of the present hospital bed with conveyor mattress so that the detailed description thereof that follows may be better understood and in order that the present contribution to the art may be better appreciated.

Objects of the present hospital bed with conveyor mattress, along with various novel features that characterize the invention are particularly pointed out in the claims forming a part of this disclosure. For better understanding of the hospital bed with conveyor mattress, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
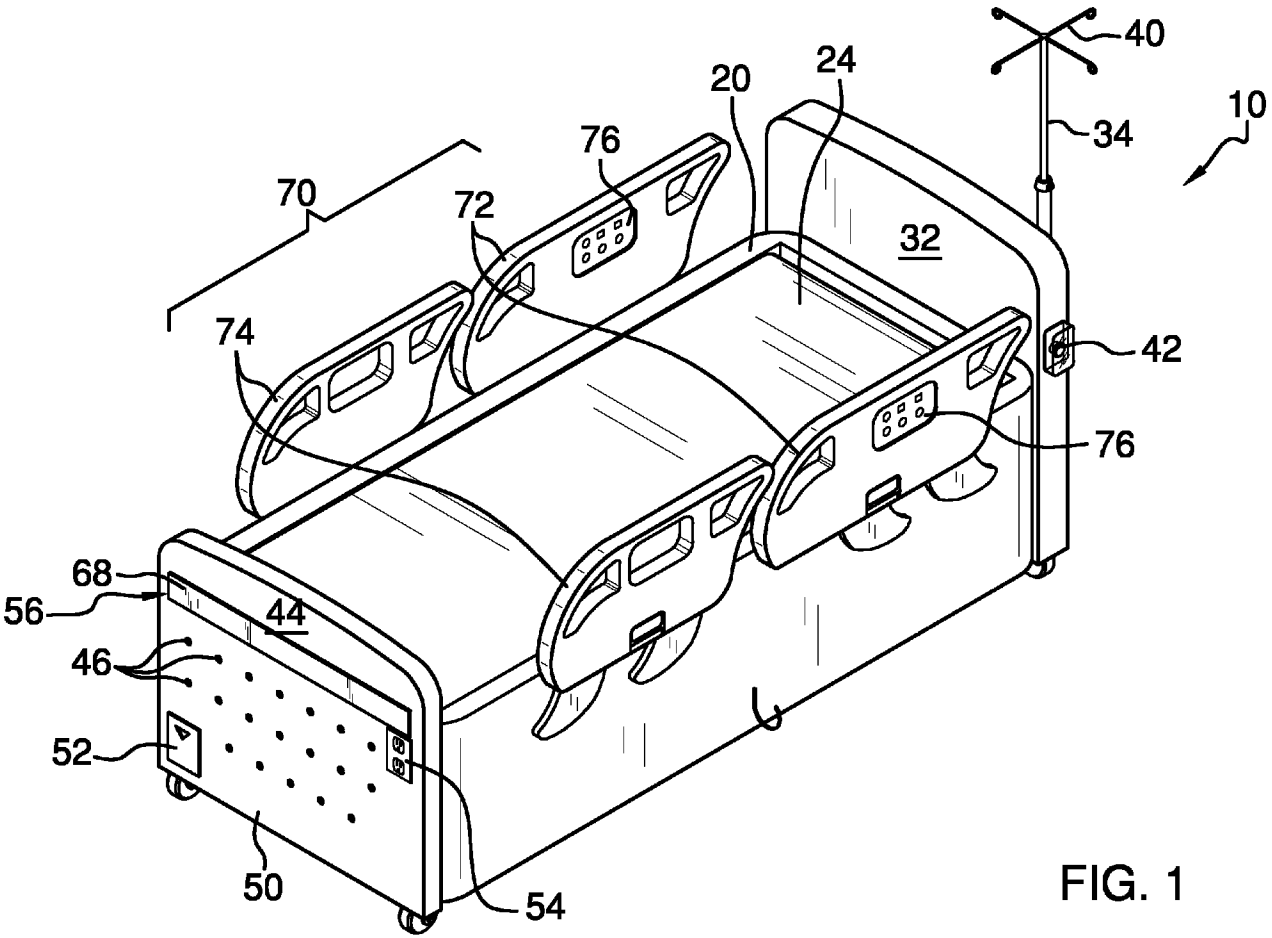
FIG. 1 is an isometric view.
Figure 2:
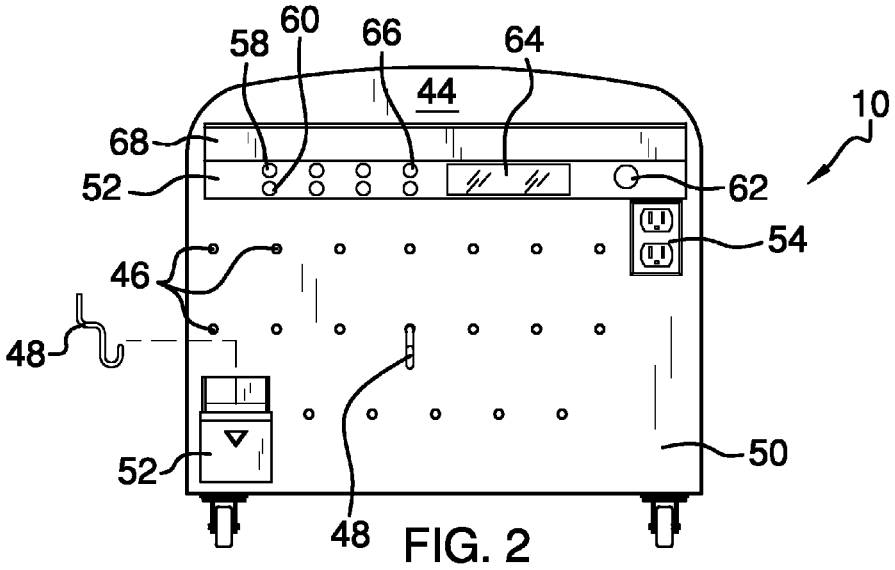
FIG. 2 is a front view of a footboard.
Figure 3:
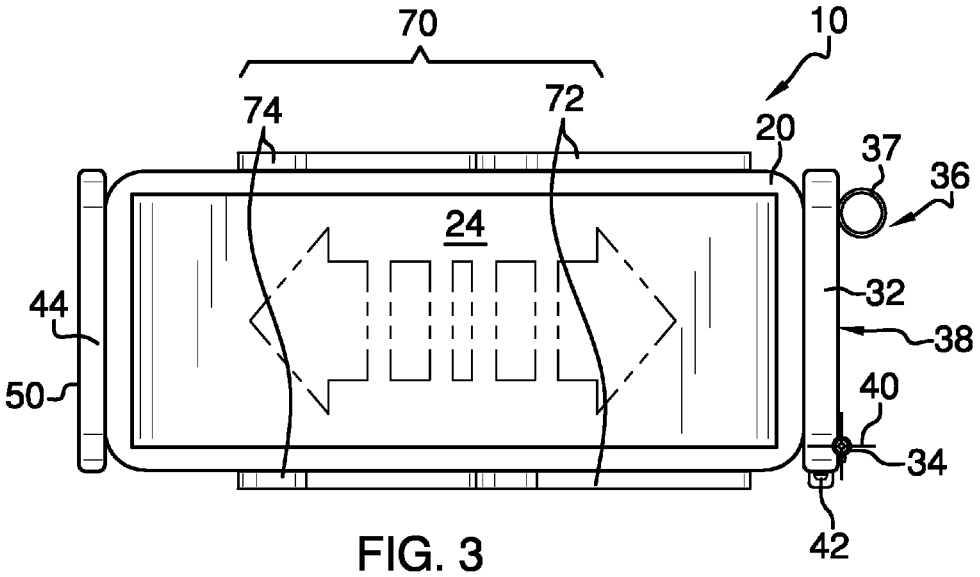
FIG. 3 is a top view.

With reference now to the drawings, and in particular FIGS. 1 through 6 thereof, example of the instant hospital bed with conveyor mattress employing the principles and concepts of the present hospital bed with conveyor mattress and generally designated by the reference number 10 will be described.

Referring to FIGS. 1 through 6 a preferred embodiment of the present hospital bed with conveyor mattress 10 is illustrated.

The present hospital bed with conveyor mattress 10 has been devised to enable repositioning of patients longitudinally upon the bed 10 while enabling inclined positions of a mattress 24 relative the ground. The instant hospital bed with conveyor mattress 10 also enables support of peripheral medical devices (not shown) and enables patient interface with extant electronics within a hospital room.

Figure 4:
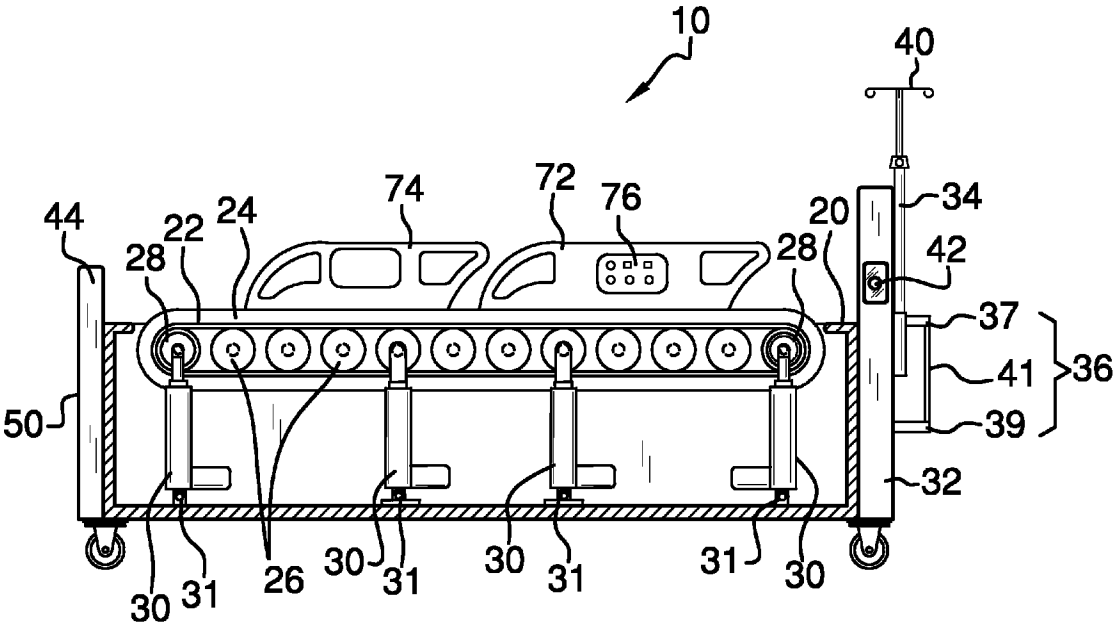
FIG. 4 is a side view with longitudinal cross-section of a mattress frame.
Figure 5:
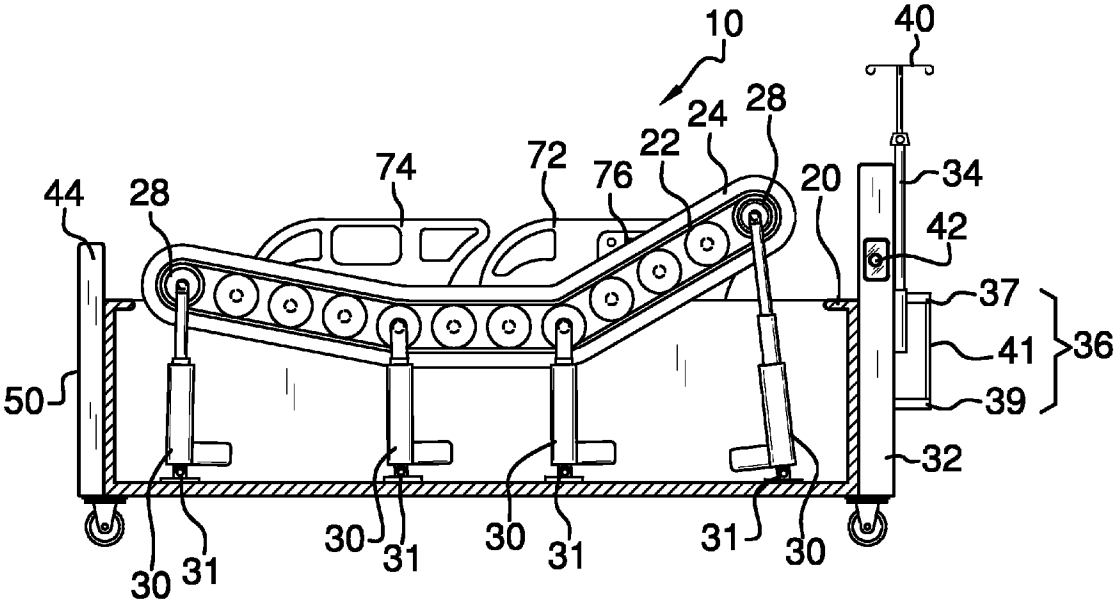
FIG. 5 is a side view with longitudinal cross-section of a mattress frame and at least one of a plurality of hydraulic jacks in an extended position.
Figure 6:
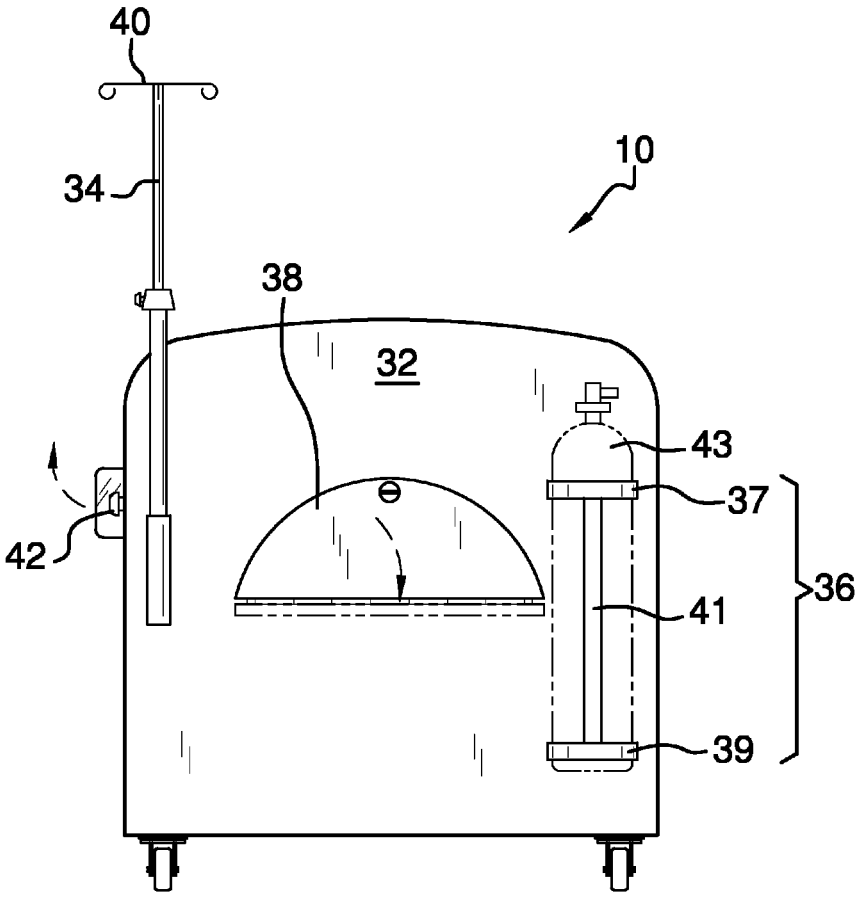
FIG. 6 is a back view of a headboard.

As shown in FIGS. 4 and 5, the hospital bed with conveyor mattress 10 includes a mattress frame 20 having a conveyor belt 22 disposed thereupon. A loop mattress 24 is rotatably disposed upon the mattress frame 20 overlying and attached to the conveyor belt 22. A plurality of transverse rollers 26 is horizontally disposed transversely within the mattress frame 20, each of said plurality of rollers 26 disposed interior to the conveyor belt 22. The plurality of transverse rollers 26 rotatably engage the conveyor belt 22 when each of said rollers 26 is rotated. Thus the mattress 24 is moveable along a longitudinal axis relative the mattress frame 20 when each of the plurality of transverse rollers 26 is rotated.

To power the rotation of the plurality of transverse rollers 26, at least one roller motor 28 is disposed in operational communication with at least one of the plurality of transverse rollers 26. The at least one roller motor 28 is configured to rotate at least one roller 26 to rotatably engage the conveyor belt 22 whereby the loop mattress 24 is rotated along a longitudinal axis relative the mattress frame 20 in each of a first direction and an opposite second direction (see FIG. 3).

To enable inclinations of sections of the hospital bed with conveyor mattress 10, and thus position a patient in selectively upright situations, as desired, or in the Trendelenburg position, for example, a plurality of hydraulic jacks 30 is disposed along either side of the mattress frame 20, each of said hydraulic jacks 30 extensible to incline a section of the mattress 24 relative another section of the mattress 24, as desired (see FIG. 5). Each of said plurality of hydraulic jacks 30 is pivotally connected to the mattress frame 20 at a pivot point 31 to enable tilting of each of the hydraulic jacks 30 when any selective one of said jacks 30 is extended relative the others.

A headboard 32 is disposed perpendicularly at the anterior end of the mattress frame 20. The headboard 32 is fitted with structure enabling support of extent peripheral medical apparatuses (not shown), including a telescopic IV support pole 34 mounted to the headboard 32, an oxygen tank holder 36, and a foldable pull-down shelf 38 (see FIG. 6). The IV support pole 34 is vertically extensible upward from the headboard 32 and includes a rack member 40 for attaching extant IV bags (not shown) and the like whereby intravenous supplements are administrable to a patient lying in the hospital bed with conveyor mattress 10.

The oxygen tank holder 36 includes a first clamp member 37 and a second clamp member 39 secured to the headboard 32 and disposed endwise upon a vertical support member 41. Each of the first and second clamp members 37, 39 may be adjustably securable to the headboard 32 and slidably mounted to the vertical support member 41. Each of the first and second clamp members 37, 39 are configured to releasably secure an oxygen tank 43 thereto in close proximity with the anterior end of a patient lying in the instant hospital bed with conveyor mattress 10. It is contemplated that the oxygen tank holder 36 may be configured to pop-out of the headboard 32, or otherwise fold away when not in use to present a flush surface of the headboard 32 to conserve space in the particular hospital room in which the bed 10 is used.

The foldable pull-down shelf 38 is disposed to hingedly open downwardly from the headboard 32 and support portable equipment (not shown), for example, which may be used to monitor a particular patient, as desired, or used in conjunction with additional medical paraphernalia as may be convenient or necessary when treating a particular patient in the hospital bed 10.

A conveyor button 42, wired to activate and deactivate the plurality of transverse rollers 26 to move the loop mattress 24 when desired, is disposed upon the side of the headboard 32 whereby a nurse, or other medical professional, may adjust the situation of the patient longitudinally upon the mattress 24, as desired. The conveyor button 42 is useable to activate the conveyor belt 22 in each of a first direction, whereby the patient is moved towards the headboard 32, and a second direction, whereby the patient is moveable towards a footboard 44 disposed at the posterior end of the bed 10.

The footboard 44 is disposed perpendicularly at the posterior end of the mattress frame 20 and includes a plurality of holes 46 disposed across a first surface 50 whereby a plurality of hooks 48, configured to releasably attach within each of the plurality of holes 46, is configurable, as desired, to support a variety of extant peripheral medical equipment and apparatuses in a variety of arrangements as may be desired when treating a particular patient with a particular treatment administered by a particular medical apparatus and its associated accoutrements.

To store said plurality of hooks 48 and keep each of said plurality of hooks 48 conveniently accessible nearby when not in use, a hook drawer 52 is disposed upon the footboard 44 accessible from the first surface 50. Thus each of the plurality of hooks 48 is tidily stored out of the way when not in use, yet able to be accessed when needed, as when setting up a peripheral medical apparatus (not shown) proximal the patient lying in the hospital bed with conveyor mattress 10.

To power extant electronic devices (not shown) that may be positioned proximal the hospital bed with conveyor mattress 10, at least one electrical outlet 54 is disposed in the footboard 44 connectable with a power source (not shown) externally situated relative the bed 10. A user may thus plug extant electronic devices (not shown) into the footboard 44, as desired, to power peripheral devices from the footboard 44 without needing a wall outlet whereby said peripheral devices may be located conveniently proximal to the hospital bed 10 for use when desired.

As is typical of hospital beds of the present day, an electronics panel 56 is included in the footboard 44. The electronics panel 56 includes standard electronic features common to state of the art hospital beds, including, for example, a Trendelenburg position indicator 58, a reverse Trendelenburg position indicator 60, a bed alarm signal 62, a bed scale readout 64, and a bed elevation indicator 66. Thus, when the bed 10 is positioned to a certain incline or decline relative the ground, the position is indicated at the electronics panel 56. Should a patient signal an alarm from the bed 10, the alarm signal 62 is also displayed at the electronics panel 56 to indicate to a passing nurse an alarm has been signaled (the alarm may also be communicated offsite to request assistance). The bed scale readout 64 is contemplated wherein the weight of a patient lying in the bed 10 is relayed to the bed scale readout 64 whereby the patient's weight is instantaneously displayed. To protect the electronics panel 56 when not in use, a hinged lid 68 is disposed upon the footboard to cover the electronics pane 56. The electronics panel 56 may also include preset positions and configurations of the mattress frame 24 wherein one-touch preset inclinations and situations of the mattress frame 24 are enabled, as desired.

A plurality of side rail members 70 is hingedly disposed on either side of the mattress frame 20, each of said plurality of side rail members 70 moveable between an upright position, enclosing each side of the hospital bed 10, and a lowered position, enabling access to the bed 10. The plurality of side rail members 70 includes a first pair of side rail members 72 disposed more proximal the headboard 32 and a second pair of side rail members 74 disposed more proximal the footboard 44. Each of the plurality of side rail members 70 is useable to secure a patient in the hospital bed with conveyor mattress 10 when said side rail members 70 are in the upright position, and access the bed 10 when each of the plurality of side rail members 70 is moved to the lowered position.

A plurality of controls 76 is disposed on at least one of the first pair of side rail members 72. Said plurality of controls 76 is usable to operate the hydraulic jacks 30 to position the mattress 24 at a desired inclination and to activate the plurality of transverse rollers 26 to maneuver the hospital bed with conveyor mattress 10, as desired, when repositioning oneself upon the mattress 24. Said plurality of controls 76 is contemplated to be interfaced with additional extant electronics peripheral to the hospital bed 10, as desired, including, for example, a television, an intercom system, a telephone, a radio, an alarm signal activation, among other functions common to hospital beds of the present day (not shown).

The hospital bed with conveyor mattress 10 therefore provides support for peripheral medical devices, is interfaced with extant additional electronics desirably accessible to a patient bedridden within a hospital room, and enables positioning of a patient within the bed 10 at various elevations relative the ground while enabling repositioning of said patient along the longitudinal axis of the mattress frame 20, as desired, when the conveyor belt 22 is activated, in each of a first direction and a second direction.

What is claimed is:

1. A hospital bed with conveyor mattress comprising:

a mattress frame;

a conveyor belt disposed upon the mattress frame;

a loop mattress rotatably disposed upon the mattress frame overlying and attached to the conveyor belt;

a plurality of transverse rollers horizontally disposed transversely within the mattress frame, each of said plurality of rollers disposed interior to the conveyor belt, said rollers rotatably engaging the conveyor belt whereby the mattress is moveable along a longitudinal axis relative the mattress frame;

at least one roller motor in operational communication with at least one of the plurality of transverse rollers, said at least one roller motor configured to rotate at least one roller and rotatably engage the conveyor belt thereby; and a plurality of hydraulic jacks disposed along either side of the mattress frame, each of said hydraulic jacks pivotally attached to the mattress frame and extensible to incline a particular section of the mattress relative another section of the mattress, as desired;

wherein the hospital bed with conveyor mattress enables positioning of a patient within the bed at various elevations and inclinations relative the ground and repositions said patient along the longitudinal axis of the mattress frame, as desired, when the conveyor belt is activated, in each of a first direction and a second direction;

a headboard disposed perpendicularly at the anterior end of the mattress frame, said headboard including:

a telescopic IV support pole mounted to the headboard;

an oxygen tank holder;

a foldable pull-down shelf; and a conveyor button wired to activate and deactivate the plurality of transverse rollers to move the loop mattress when desired;

wherein the telescopic IV support is extensible vertically upward from the headboard to support an extant IV bag and apparatus and the oxygen tank holder releasably and adjustably supports an extant oxygen tank of varying sizes;

a footboard disposed perpendicularly at the posterior end of the mattress frame, said footboard comprising:

a plurality of holes;

a plurality of hooks configured to releasably secure within each of the plurality of holes whereby extant tubing and additional medical accoutrements are supportable thereat;

a hook drawer disposed to releasably store said plurality of hooks when not in use;

an electrical outlet configured to receive plugs of extant electronics;

an electronics panel comprising:

a Trendelenburg position indicator;

a reverse Trendelenburg position indicator;

a bed alarm signal;

a bed scale read out;

a bed elevation indicator; and a hinged lid disposed to cover the electronics panel when not in use.

2. The hospital bed with conveyor mattress of claim 1 further comprising a plurality of side rail members hingedly disposed on either side of the mattress frame, each of said plurality of side rail members moveable between an upright position, enclosing each side of the hospital bed, and a lowered position, enabling access to the bed, said plurality of side rail members comprising:

a first pair of side rail members disposed more proximal the headboard;

a second pair of side rail members disposed more proximal the footboard; and a plurality of controls disposed on at least one of the first pair of side rail members, said plurality of controls usable to operate the hydraulic jacks and the plurality of transverse rollers to maneuver a patient upon the hospital bed with conveyor mattress, said plurality of controls interfaced with additional extant electronics peripheral to the hospital bed, as desired;

wherein the hospital bed with conveyor mattress is interfaced with extant additional electronics desirably accessible to a patient bedridden within a hospital room and enables positioning of the patient within the bed at various elevations relative the ground and repositioning of said patient along the longitudinal axis of the mattress frame, as desired, when the conveyor belt is activated, in each of a first direction and a second direction.

3. A hospital bed with conveyor mattress comprising:

a mattress frame;

a conveyor belt disposed upon the mattress frame;

a loop mattress rotatably disposed upon the mattress frame overlying and attached to the conveyor belt;

a plurality of transverse rollers horizontally disposed transversely within the mattress frame, each of said plurality of rollers disposed interior to the conveyor belt, said rollers rotatably engaging the conveyor belt whereby the mattress is moveable along a longitudinal axis relative the mattress frame;

at least one roller motor in operational communication with at least one of the plurality of transverse rollers, said at least one roller motor configured to rotate at least one roller and rotatably engage the conveyor belt thereby;

a plurality of hydraulic jacks disposed along either side of the mattress frame, each of said hydraulic jacks pivotally attached to the mattress frame and extensible to incline a particular section of the mattress relative another section of the mattress, as desired;

a headboard disposed perpendicularly at the anterior end of the mattress frame, said headboard including:

a telescopic IV support pole mounted to the headboard;

an oxygen tank holder;

a foldable pull-down shelf;

a conveyor button wired to activate and deactivate the plurality of transverse rollers to move the loop mattress when desired;

a footboard disposed perpendicularly at the posterior end of the mattress frame, said footboard comprising:

a plurality of holes;

a plurality of hooks configured to releasably secure within each of the plurality of holes;

a hook drawer disposed to releasably store said plurality of hooks when not in use;

an electrical outlet configured to receive plugs of extant electronics;

an electronics panel including:

a Trendelenburg position indicator;

a reverse Trendelenburg position indicator;

a bed alarm signal;

a bed scale read out;

a bed elevation indicator;

a hinged lid disposed to cover the electronics panel when not in use;

a plurality of side rail members hingedly disposed on either side of the mattress frame, each of said plurality of side rail members moveable between an upright position, enclosing each side of the hospital bed, and a lowered position, enabling access to the bed, said plurality of side rail members comprising:

a first pair of side rail members disposed more proximal the headboard;

a second pair of side rail members disposed more proximal the footboard; and a plurality of controls disposed on at least one of the first pair of side rail members, said plurality of controls usable to operate the hydraulic jacks and the plurality of transverse rollers to maneuver a patient upon the hospital bed with conveyor mattress, said plurality of controls interfaced with additional extant electronics peripheral to the hospital bed, as desired;

wherein the hospital bed with conveyor mattress provides support for peripheral medical devices, is interfaced with extant additional electronics desirably accessible to a patient bedridden within a hospital room, and enables positioning of a patient within the bed at various elevations relative the ground and repositioning of said patient along the longitudinal axis of the mattress frame, as desired, when the conveyor belt is activated in each of a first direction and a second direction.

* * * * *